US008389451B2

(12) United States Patent
Deckman et al.

(10) Patent No.: US 8,389,451 B2
(45) Date of Patent: Mar. 5, 2013

(54) LUBRICANT AIR RELEASE RATES

(75) Inventors: Douglas E. Deckman, Mullica Hill, NJ (US); David J. Baillargeon, Cherry Hill, NJ (US); Andrew G. Horodysky, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1168 days.

(21) Appl. No.: 11/880,207

(22) Filed: Jul. 20, 2007

(65) Prior Publication Data

US 2008/0026969 A1 Jan. 31, 2008

Related U.S. Application Data

(60) Provisional application No. 60/833,873, filed on Jul. 28, 2006.

(51) Int. Cl.
*C10M 143/10* (2006.01)

(52) U.S. Cl. ..... 508/591; 585/11; 585/12

(58) Field of Classification Search ..... 508/463, 508/591, 221, 459; 585/11
See application file for complete search history.

(56) References Cited

U.S. PATENT DOCUMENTS

| | | | | |
|---|---|---|---|---|
| 4,900,875 | A | 2/1990 | Rhodes et al. | |
| 5,382,374 | A | 1/1995 | Takemitsu et al. | |
| 5,534,170 | A | 7/1996 | Watts | |
| 5,631,212 | A | 5/1997 | Vrahopoulou | |
| 5,747,433 | A | 5/1998 | Luciani et al. | |
| 6,090,758 | A | 7/2000 | Pillon et al. | |
| 6,103,099 | A | 8/2000 | Wittenbrink et al. | |
| 6,180,575 | B1 | 1/2001 | Nipe | |
| 6,251,840 | B1 | 6/2001 | Ward, Jr. et al. | |
| 6,303,550 | B1 * | 10/2001 | Wedlock et al. | 508/591 |
| 6,528,694 | B1 * | 3/2003 | Chiga | 585/11 |
| 6,583,092 | B1 | 6/2003 | Carrick et al. | |
| 6,599,867 | B2 | 7/2003 | Hammond et al. | |
| 6,610,636 | B2 | 8/2003 | Berlowitz et al. | |
| 6,642,188 | B1 | 11/2003 | Hartley et al. | |
| 6,713,438 | B1 * | 3/2004 | Baillargeon et al. | 508/463 |
| 6,784,143 | B2 | 8/2004 | Locke et al. | |
| 6,833,065 | B2 | 12/2004 | O'Rear | |
| 6,852,679 | B2 | 2/2005 | Hartley et al. | |
| 6,869,919 | B2 * | 3/2005 | Ritchie et al. | 508/221 |
| 6,916,766 | B2 | 7/2005 | Buzdygon et al. | |
| 7,045,654 | B2 | 5/2006 | Hobbs | |
| 2003/0088133 | A1 | 5/2003 | O'Rear | |
| 2003/0191031 | A1 | 10/2003 | Buzdygon et al. | |
| 2004/0119046 | A1 | 6/2004 | Carey et al. | |
| 2004/0121918 | A1 | 6/2004 | Rea et al. | |

(Continued)

FOREIGN PATENT DOCUMENTS

| | | |
|---|---|---|
| EP | 0819755 | 1/1998 |
| WO | 2004087849 | 10/2004 |

OTHER PUBLICATIONS

Biswajit Basu, et al., "Air-Entrainment Phenomenon in Mineral Lubricating Oils", Presented at the 39th Annual Meeting of ASLE (Am. Soc. Lubr. Eng.), Chicago, Illinois, May 7-10, 1984, vol. 28, 3 pp. 313-324.

*Primary Examiner* — Ellen McAvoy
*Assistant Examiner* — Chantel Graham
(74) *Attorney, Agent, or Firm* — Robert A. Migliorini

(57) ABSTRACT

The air release rate of lubricating compositions is significantly enhanced when the composition is formulated with one or more vinyl aromatic-olefin block copolymers that forms a micelle-like structure in the oil. Compositions having the specified copolymers retain less than about 2.5% air after 1 min. at 50° C. when tested by ASTM D 3427.

2 Claims, 1 Drawing Sheet

U.S. PATENT DOCUMENTS

2004/0121921 A1 6/2004 Calcut et al.
2004/0154957 A1 8/2004 Keeney et al.
2004/0235688 A1 11/2004 Locke et al.
2004/0242434 A1 12/2004 Yagishita et al.
2005/0065043 A1 3/2005 Henly
2005/0077208 A1 4/2005 Miller et al.
2005/0101494 A1 5/2005 Iyer et al.
2005/0133407 A1 6/2005 Abernathy et al.
2005/0153848 A1 7/2005 Bell et al.
2005/0176593 A1 8/2005 Ward, Jr. et al.
2005/0192186 A1 9/2005 Iyer et al.
2005/0202979 A1 9/2005 Henly
2006/0035792 A1 2/2006 Hall
2006/0116299 A1 6/2006 Arrowsmith et al.
2006/0116300 A1 6/2006 Arrowsmith et al.
2006/0116302 A1 6/2006 Deckman et al.

* cited by examiner

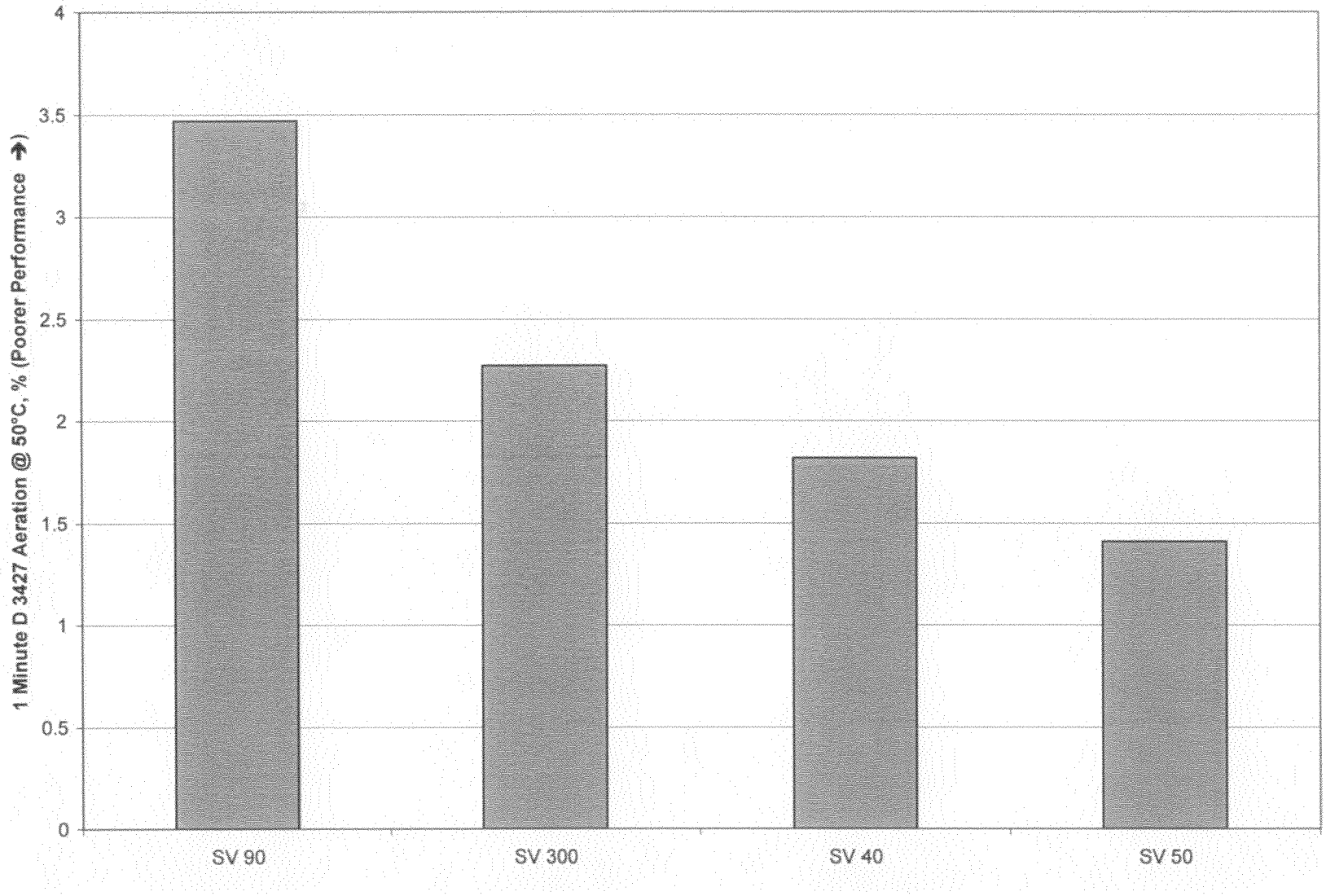
1 Minute D 3427 Aeration @ 50°C, % (Poorer Performance ➔)
4
3.5
3
2.5
2
1.5
1
0.5
0
SV 90
SV 300
SV 40
SV 50

LUBRICANT AIR RELEASE RATES

This application claims priority of Provisional Application 60/833,873 filed Jul. 28, 2006.

FIELD OF THE INVENTION

The invention relates to lubricant compositions exhibiting good rates of air release. More particularly, the invention relates to a method for enhancing the rate of air release of a lubricant composition by use of certain vinyl aromatic-olefin block copolymers.

BACKGROUND OF THE INVENTION

Lubricating oils, including hydraulic oils and crankcase oils, often are used in environments in which the oil is subject to mechanical agitation in the presence of air. As a consequence, the air becomes entrained in the oil and also forms a foam.

Foam appears on the surface of an oil as air bubbles greater than 1 mm in diameter. Air entrainment refers to the dispersion within the oil of air bubbles less than 1 mm in diameter.

Air entrainment and foaming in lubricating compositions are undesirable phenomena. For example, air entrainment reduces the bulk modulus of the fluid resulting in spongy operation and poor control of a hydraulic system's response. It can result in reduced viscosity of a lubricating composition. Both air entrainment and foaming can contribute to fluid deterioration due to enhanced oil oxidation.

Air entrainment, however, is more problematic than foaming. Foaming is typically depressed in lubricating compositions by the use of antifoamant additives. These additives expedite the breakup of a foam, but they do not inhibit air entrainment. Indeed, some antifoamants, such as silicone oils typically used in diesel and automotive crankcase oils, are known to retard air release. The rate of air release and amount of air entrainment of lubricating compositions may be determined by the test method of ASTM D 3427. Indeed, the rate of air release referred to herein has been determined by that method.

U.S. Pat. No. 6,090,758 discloses that foaming in a lubricant comprising a slack wax isomerate is effectively reduced by use of an antifoamant exhibiting a spreading coefficient of about 2 mN/m without increasing the air release time. While the specified antifoamant does not degrade the air release time, further improvements in enhancing air release characteristics are desirable.

Many modern gasoline and diesel engines are designed to use the crankcase oil to function as a hydraulic fluid to operate fuel injectors, valve train controls and the like. For these functions, low air entrainment and rapid air release are indicative of high performance lubricants. Indeed, it is anticipated that in the future the rate of air release from engine lubricants will become more critical to the proper operation of internal combustion engines as engine designs evolve and become ever more complex.

U.S. Pat. No. 6,713,438 discloses a lubricating oil composition that exhibits improved air release characteristics. The composition comprises a basestock, typically a polyalphaolefin (PAO), and two polymers of different molecular weight. One of the polymers is a viscoelastic fluid having a shear stress greater than 11 kPa such as a high VI PAO, and the other preferably is a linear block copolymer.

The present invention provides desirable improvements in lubricant air release rates through the use of certain vinyl aromatic-olefin block copolymers.

SUMMARY OF THE INVENTION

It has now been discovered that lubricant compositions formulated with vinyl aromatic-olefin block copolymers that form a micelle-like structure in oil exhibit enhanced air release rates when compared to lubricant compositions formulated with vinyl aromatic-olefin block copolymers that do not form a micelle-like structure in oil.

Thus, one aspect of the invention comprises a method for improving the rate of air release of a lubricating composition comprising a major amount of a lubricating base oil, the method comprising adding to the lubricating base oil a minor amount of at least one vinyl aromatic-vinyl block copolymer that forms a micelle-like structure in said base oil.

Another aspect of the invention is a lubricating composition comprising (a) a major amount of an oil of lubricating viscosity, and (b) at least one vinyl aromatic-olefin block copolymer that forms a micelle-like structure in the oil in an amount sufficient to enhance the air release rate of the composition, the composition being substantially free of a viscoelastic fluid, said fluid having both a shear stress greater than 11 kPa and a kinematic viscosity greater than about 30 cSt at 100° C.

In another aspect, lubricating oil compositions formulated according to the invention are particularly useful as crankcase lubricants in engines wherein the lubricant provides a lubricating and a hydraulic function.

The foregoing summary and the following detailed description are exemplary of the various aspects and embodiments of the claimed invention.

BRIEF DESCRIPTION OF THE DRAWING

The accompanying sole FIGURE is a bar graph illustrating the invention.

DETAILED DESCRIPTION OF THE INVENTION

Listed below are the methods used to determine the various properties of compositions referred to herein:

(a) Air release rate—ASTM D 3427

(b) Kinematic viscosity—ASTM D 445

(c) Viscosity index—ASTM D 2270

(d) Shear stress—SAE Paper No. 872043

(e) High temperature high stability (HTHS)—ASTM D 4683

(f) Sulfated ash—ASTM D 874

(g) Sulfur—ASTM D 6443

(h) Phosphorous—ASTM D 4951.

For convenience, the invention will be described by reference to engine oils; however, it should be appreciated that in some aspects, the invention is also applicable to other types of lubricants such as hydraulic fluid, industrial oils and the like.

A key advantage of the present invention is that it provides a method to enhance the air release rate of a lubricating composition by formulating the composition without a highly viscoelastic fluid and by incorporating in the composition specified vinyl aromatic-olefin block copolymers.

Lubricating compositions to which the invention is applicable are especially those comprising one or more oils of lubricating viscosity selected from Group II, III, IV or V base stocks. The base stock groups are defined in the American Petroleum Institute Publication "Engine Oil Licensing and Certification System," Fourteenth Edition, December 1966, Addendum 1, December 1998. The base stock typically will have a viscosity of about 3 to 12, preferably 4 to 10, and more preferably 4.5 to 8 $mm^2/s$ (cSt) at 100° C.

Group II base stocks generally have a viscosity index (VI) of between about 80 and 120 and contain 0.03 wt % sulfur or less and 90 wt % or more saturates. Group III base stocks generally have a VI greater than about 120, 0.03 wt % or less sulfur and 90 wt % or more saturates. Group IV base stocks are polyalphaolefins (PAO). A particularly suitable Group III base stock is a gas-to-liquid (GTL) base stock such as a base stock derived from a waxy hydrocarbon produced in a Fischer-Tropsch (F-T) process.

As is known to those skilled in the art, in an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but which is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid.

The stoichiometric mole ratio of hydrogen and CO for an F-T synthesis reaction is 2.0, but there are many reasons for using other than a stoichiometric ratio as those skilled in the art know. In cobalt slurry hydrocarbon synthesis processes the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used.

Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures in the range of from about 320-850° F., pressures in the range of from about 80-600 psi and hourly gas space velocities of from about 100-40,000 V/hr/V, expressed as standard volumes of the gaseous CO and $H_2$ mixture (0° C., 1 atm) per hour per volume of catalyst, respectively.

It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha (Schultz-Flory kinetic alpha) of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. While suitable F-T types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise titania. Non-limiting examples of useful F-T catalysts and their preparation may be found, in U.S. Pat. Nos. 4,568,663; 4,663,305; 4,542,122; 4,621,072 and 5,545,674.

The waxy hydrocarbon produced in the F-T synthesis process, i.e., the F-T wax, preferably has an initial boiling point in the range of from 650° F. to 750° F. and preferably boils up to an end point of at least 1050° F.

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.$^-$ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricating base oil from the F-T wax may be characterized as a hydrodewaxing process. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Hydrodewaxing catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, preferably platinum on ZSM-48, in the hydroisomerization of the waxy feedstock eliminates the need for any subsequent, separate dewaxing step, and is preferred.

A dewaxing step, when needed, may be accomplished using either well known solvent or catalytic dewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Low molecular weight hydrocarbons, such as propane, are also used for dewaxing, in which the hydroisomerate is mixed with liquid propane, a least a portion of which is flashed off to chill down the hydroisomerate to precipitate out the wax.

The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

The GTL base stock suitable for use in the invention typically will have a kinematic viscosity in the range of about 2 to 50 $mm^2/s$ at 100° C. and preferably in the range of about 3.5 to 30 $mm^2/s$ at 100° C. Furthermore, suitable GTL basestocks typically have a VI greater than about 130, preferably greater than 135 and more preferably 140 or greater.

The GTL base stock suitable for use in the invention is further characterized as typically having a pour point of −5° C. or lower, preferably about −10° C. or lower and under some conditions advantageously having pour points of about −25° C. to about −40° C. A preferred GTL base stock is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85(CH_2 \geqq 4)<45$ as measured over said liquid hydrocarbon composition as a whole.

The preferred GTL base stock can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geqq 25.4$ and $(CH_2 \geqq 4) \leqq 22.5$. They have a nominal boiling point of 370° $C.^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV @ 100° C.)−7000.

The preferred GTL base stock is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3. In the above the Branching Index (BI), Branching Proximity ($CH_2 \geqq 4$), and Free Carbon Index (FCI) are determined as follows:

Branching Index

A 359.88 MHz 1 H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the a-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 $MHz^3CMR$ single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ~29.8 ppm is due to equivalent recurring methylene carbons which are four or more removed from an end group or branch ($CH_2$>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a. calculate the average carbon number of the molecules in the sample which is accomplished with sufficient accuracy for lubricating oil materials by simply dividing the molecular weight of the sample oil by 14 (the formula weight of $CH_2$);

b. divide the total carbon-13 integral area (chart divisions or area counts) by the average carbon number from step a. to obtain the integral area per carbon in the sample;

c. measure the area between 29.9 ppm and 29.6 ppm in the sample; and d. divide by the integral area per carbon from step b. to obtain FCI.

Branching measurements can be performed using any Fourier Transform NMR spectrometer. Preferably, the measurements are performed using a spectrometer having a magnet of 7.0T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

Suitable polyalphaolefins (PAOs) for use in compositions of the invention comprise relatively low molecular weight hydrogenated polymers or oligomers of alphaolefins such as $C_2$ to $C_{32}$ alphaolefins with $C_8$ to $C_{16}$ alphaolefins being preferred.

The PAO base stocks are conveniently made by the polymerization of alphaolefins in the presence of a polymerization catalyst such as the Friedel-Crafts catalysts. Examples of PAO synthesis can be found in U.S. Pat. Nos. 3,742,082; 3,769,363; 4,413,156; 4,434,408; 4,910,355; and 4,956,122 to mention a few.

Suitable Group V base stocks include esters, especially polyol esters such as trimethylolpropane caprylate and pentaerythritol-2-ethyl hexanoate; alkylaromatics such as alkylbenzenes and alkylnapthalenes; polyoxyalkylene glycols; and polyphenyl ethers.

A lubricating composition of the invention comprises a major amount of an oil of lubricating viscosity and especially one or more oils selected from Group II, Group III (including GTL), Group IV and Group V base stocks. By major amount is meant greater than 50 wt %, conveniently between 75 wt % to 90 wt % and preferably between 65 wt % to 80 wt %, based on the total weight of the lubricating composition.

According to the present invention, the air release rate of a lubricating composition comprising a major amount of an oil of lubricating viscosity can be improved by using a minor amount of at least one vinyl aromatic-olefin block copolymer that forms a micelle-like structure in the oil. Stated differently, the specified vinyl aromatic-olefin block copolymers of the invention form colloidal aggregates in the oil which are readily determined by light scattering techniques well known in the art.

The vinyl aromatic-olefin block copolymers useful in the present invention are produced by the anionic polymerization of vinyl aromatics with olefins. Useful vinyl aromatics include vinylbenzene(styrene), vinyltoluene, vinylxylene, divinylbenzene, and the like. Useful olefins are those having from about 4 to 10 carbon atoms and especially isoprene and butadiene. Copolymers of the type are described in U.S. Pat. Nos. 5,187,236; 5,268,427; 5,276,100; 5,292,820 and 5,399,629 among others. In one aspect of the invention, preferred copolymers are linear styrene-isoprene block copolymers. It has been observed that the linear styrene-diene block copolymers that form a micelle-like structure in oil generally have a greater amount of styrene in the copolymer whereas those linear styrene-diene block copolymers that do not form a micelle-like structure generally have a greater amount of diene in the copolymer. In the case of the linear styrene-diene block copolymers, the styrene blocks tend to associate inwardly in the aggregates with the diene tails being arranged outwardly. Copolymers formed from divinylbenzene and a diene are star-like in structure with a divinylbenzene core and outwardly extending diene tails. Hence, star-like copolymers can be thought of as a covalently bonded equivalents of micelle structures (micelle-like structures), and for the purposes of this invention, are deemed to result in a micelle-like structure in oil.

Blends of the suitable linear styrene-diene block copolymers are effective in increasing the air release rates of lubricant compositions. Also useful are blends of the linear styrene-diene block copolymers with divinylbenzene-diene star copolymers. The weight ratio of the linear styrene-diene block copolymers to divinylbenzene diene star copolymers in such blends typically will be in the range of about 1:3 to about 3:1.

Certain vinyl aromatic-olefin block copolymers have been previously used to improve the VI of lubricating compositions. However, we have now found that, when used in suitable amounts, a certain class of such copolymers can be used to improve the air release properties of lubricating compositions. The specified vinyl aromatic-diene copolymer(s) will be used in amounts sufficient to enhance the rate of air release of the lubricant composition. Preferably, the amount used will promote the composition with an air release rate such that less than about 2.5% air will remain in the composition after 1 min. at 50° C. as determined by ASTM D 3427. Conveniently, the block copolymers are used in amounts greater than about 5 wt % and may range up to about 20 wt % of the total weight of the lubricating composition.

Since the amounts and types of copolymers used to achieve the desired air release properties might not be suitable to achieve the desired VI, lubricant compositions of the invention may optionally also include other VI improvers, such as olefin copolymer VI improvers other than those used to improve the air release properties of the composition and methacrylate VI improvers, provided that such other VI improvers do not have a negative effect on the air release rate of the composition.

In addition to the base stocks and the specified block copolymers of the compositions of the invention, the present lubricant compositions may also include further additives to impart or enhance the desired properties of the fully formulated composition. These additives may be selected from conventional types normally required. For example, they may include oxidation inhibitors, dispersants, detergents, corrosion inhibitors, metal deactivators, antiwear agents, extreme pressure additives, pour point depressants, seal compatibility agents, friction modifiers and defoamants.

In one embodiment of the invention, preferred detergents are one or more salicylate detergents, especially sulfur-free salicylate detergents, such as alkali and alkaline earth metal alkyl salicylates, and ashless salicylate detergents, such as amides and esters of alkylsalicylic acid. Typically, the alkylsalicylic acid will have one or more alkyl groups of at least 8 carbon atoms in the alkyl groups, with 10 to 20 carbon atoms being preferred. The beneficial effect of salicylate detergents on the air release rates of lubricant compositions is disclosed in copending application Ser. No. 11/880,209 which claims priority of Provisional Application 60/883,872 filed Jul. 28, 2006 and which is incorporated herein by reference.

In one embodiment of the invention, three salicylate detergents are used, each with a different total base number (TBN). One detergent will have a TBN greater than 200; a second will have a TBN of about 100 to 200; and a third, a TBN of less than about 100. For example, in an especially preferred embodiment, the detergent comprises three calcium salicylate detergents, one with a 270 TBN, another with a 170 TBN and yet another with a 70 TBN. On an active ingredient basis, the ratio of the three (from high to low TBN) is about 1.3:0.5:0.6 respectively.

In the compositions of the invention, the salicylate detergent will be used in an amount sufficient to provide the composition with a TBN in the range of about 4 to 8 and preferably about 7. Typically, on an active ingredient basis, the salicylate detergent will comprise about 1 wt % to about 3 wt % based on the total weight of the composition.

Examples of suitable antioxidants include aminic antioxidants and phenolic antioxidants. Typical aminic antioxidants include alkylated aromatic amines, especially those in which the alkyl group contains no more than 14 carbon atoms. Typical phenolic antioxidants include derivatives of dihydroxy aryl compounds in which the hydroxyl groups are in the o- or p-position to each other and which contain alkyl substituents. Mixtures of phenolic and aminic antioxidants also may be used. Such additives may be used in an amount of about 0.02 to 5 wt %, and preferably about 0.1 wt % to about 2 wt % based on the total weight of the composition.

Rust inhibitors selected from the group consisting of nonionic polyoxyalkylene polyols and esters thereof, polyoxyalkylene phenols, and aminic alkyl sulfonic acids may be used.

Corrosion inhibitors that may be used include benzotriazoles, tolyltriazoles and their derivatives.

Suitable dispersants include succinimide dispersants, ester dispersants, ester-amide dispersants, and the like. Preferably, the dispersant is a succinimide dispersant, especially a polybutenyl succinimide. The molecular weight of the polybutenyl group may range from about 800 to about 4000 or more and preferably from about 1300 to about 2500. The dispersant may be head capped or borated or both.

A commonly used class of antiwear additives is zinc dialkyldithio-phosphates in which the alkyl groups typically have from 3 to about 18 carbon atoms with 3 to 10 carbon atoms being preferred.

Suitable antifoam additives include silicone oils or polysiloxane oils usually used in amounts of from 0.0001 to 0.01 wt % active ingredient.

Pour point depressants are well known lubricant additives. Typical examples are dialkylfumarates, polyalkylmethacrylates, and the like.

The number and types of friction modifiers are voluminous. In general, they include metal salts of fatty acids, glycerol esters and alkoxylated fatty amines to mention a few.

Another additive often used in crankcase lubricants is a VI improver such as linear or radial styrene-isoprene VI improvers, olefin copolymers, polymethacrylates, and the like.

In general, on an active ingredient basis, the various lubricant additives will comprise from about 0.5 wt % to about 25 wt % and preferably from about 2 wt % to about 10 wt % based on the total weight of the composition except where otherwise specified herein.

Preferably, the composition of the invention is substantially free of added viscoelastic fluids that have both a shear stress greater than 11 kPa and a kinematic viscosity greater than 30 cSt at 100° C. Any amount of such material that does not affect the air release rate of the composition may be present; however, it is preferred that the composition be totally free of such material.

In one embodiment of the invention, the lubricating composition, when fully formulated, will have a sulfated ash content of less than about 0.8 wt %, a sulfur content of less than about 0.25 wt % and a phosphorous content of less than about 0.8 wt % based on the total weight of the composition.

EXAMPLES

A series of 0W-30 engine oils were formulated to the same HTHS viscosity, i.e., 2.9 cP at 150° C., using different vinyl aromatic-olefin block copolymers. The block copolymers were styrene-isoprene block copolymers and a divinylbenzene-isoprene star copolymer sold by Shell Chemical Company under the trade name Shellvis. Shellvis 40, 50 and 90 are linear styrene-isoprene block copolymers. Shellvis 90 has less styrene content than Shellvis 40 and 50. Shellvis 40 and 50, unlike Shellvis 90, form a micelle-like structure in oil. Shellvis 300 is a divinyl-isoprene star polymer that also forms a micelle-like structure in oil.

Each of the formulations contained the same detergent, dispersant and inhibitor components. The compositions are set forth in Table 1.

TABLE 1

| Components, wt % | Example 1 | Example 2 | Example 3 | Comparative Example 1 |
|---|---|---|---|---|
| Additives | 12.35 | 12.35 | 12.35 | 12.35 |
| Shellvis 50 | 17 | | | |
| Shellvis 40 | | 15.95 | | |
| Shellvis 300 | | | 8.5 | |
| Shellvis 90 | | | | 8.3 |
| PAO | 63.65 | 64.7 | 72.15 | 72.35 |
| Alkylate Aromatic | 7 | 7 | 7 | 7 |
| Total | 100 | 100 | 100 | 100 |

The air release rates of the various formulations was determined using ASTM D 3427. The results are shown graphically in the accompanying FIGURE.

As can be seen, the styrene-isoprene block copolymers that form micelle-like structures in oil have significantly enhanced air release rates. All US patents, applications and non-patent references cited in this application are hereby incorporated in their entirety by reference.

What is claimed is:

1. A method for improving the air release rate of a lubricant composition comprising a major amount of a lubricating base oil and which composition is substantially free of a viscoelastic fluid having both a shear stress greater than 11 kPa and a kinematic viscosity greater than 30 cSt at 100° C., the method comprising adding to the lubricating base oil greater than about 5 wt % of a combination of vinylaromatic-olefin block copolymers that forms a micelle-like structure in the base oil; wherein the vinylaromatic-olefin block copolymer combination is a combination of a linear styrene-diene copolymer in which diene has from 4 to about 10 carbon atoms and of a divinylbenzene-isoprene star copolymer; and wherein the linear styrene-diene copolymer and divinylbenzene-isoprene star copolymer are in a weight ratio of from 1:3 to 3:1 respectively.

2. A lubricating composition comprising:

(a) a major amount of an oil of lubricating viscosity, and (b) greater than about 5 wt % of a combination of vinylaromatic-olefin block copolymers that forms a micelle-like structure in oil to enhance the air release rate of the composition, the composition being substantially free of a viscoelastic fluid, said fluid having a shear stress greater than 11 kPa and a kinematic viscosity of greater than 30 cSt at 100° C., wherein the vinylaromatic block copolymer combination is a combination of linear styrene-diene block copolymer in which the diene has from 4 to about 10 carbon atoms and of a divinylbenzene-isoprene star copolymer in a weight ratio of from about 1:3 to about 3:1.

* * * * *